US007600283B2

(12) United States Patent
Nelson

(10) Patent No.: US 7,600,283 B2
(45) Date of Patent: Oct. 13, 2009

(54) PREFABRICATED, PRESTRESSED BRIDGE SYSTEM AND METHOD OF MAKING SAME

(75) Inventor: Guy Nelson, Grand Rapids, MI (US)

(73) Assignee: Tricon Engineering Group, Ltd., Wyoming, MI (US)

( * ) Notice: Subject to any disclaimer, the term of this patent is extended or adjusted under 35 U.S.C. 154(b) by 477 days.

(21) Appl. No.: 11/337,206

(22) Filed: Jan. 20, 2006

(65) Prior Publication Data

US 2006/0162102 A1 Jul. 27, 2006

Related U.S. Application Data

(60) Provisional application No. 60/645,990, filed on Jan. 21, 2005.

(51) Int. Cl.
*E01D 21/00* (2006.01)

(52) U.S. Cl. ..... 14/77.1

(58) Field of Classification Search ..... 14/73, 14/73.1, 77.1; 52/432, 414, 223.1, 223.6–223.9, 52/223.11, 223.14

See application file for complete search history.

(56) References Cited

U.S. PATENT DOCUMENTS

| | | | | | |
|---|---|---|---|---|---|
| 1,656,197 | A | * | 1/1928 | Henderson | 52/259 |
| 1,890,432 | A | * | 12/1932 | Billner | 52/432 |
| 1,912,290 | A | * | 5/1933 | Marks | 52/432 |
| 2,064,788 | A | * | 12/1936 | Faber | 52/432 |
| 2,308,943 | A | * | 1/1943 | Tietig et al. | 52/781 |
| 2,373,072 | A | * | 4/1945 | Wichert | 52/251 |
| 2,382,139 | A | | 8/1945 | Cueni | |
| 3,327,028 | A | * | 6/1967 | Rosenblatt | 264/34 |
| 3,473,273 | A | * | 10/1969 | Gunkel | 52/79.1 |
| 3,566,558 | A | | 3/1971 | Comolli | |
| 3,794,433 | A | * | 2/1974 | Schupack | 404/1 |

(Continued)

FOREIGN PATENT DOCUMENTS

WO WO 2004101892 A1 * 11/2004

OTHER PUBLICATIONS

Shun-ichi Nakamura, "Bending Behavior of Composite Girders with Cold Formed Steel U Section," Journal of Structural Engineering, 1169-76 (Sep. 2002).

(Continued)

*Primary Examiner*—Gary S Hartmann
(74) *Attorney, Agent, or Firm*—Price, Heneveld, Cooper, DeWitt & Litton LLP

(57) ABSTRACT

The prefabricated, prestressed bridge system comprises one or more prefabricated, prestressed bridge modules. Each module includes one or more steel beams arranged in a first direction on three or more supporting formwork elements that are arranged in a second direction generally perpendicular to the first direction. Rebar runs through the steel beams in a direction perpendicular to the steel beams and above at least two of the supporting formwork elements. Concrete material is poured to form concrete diaphragms on top of and around the rebar at locations above the supporting formwork elements. After the diaphragms are poured, one or more of the supporting formwork elements are adjusted to stress the steel beams. A concrete deck is fabricated over the surface atop the diaphragms and the steel beams such that the resulting compression stress of the concrete deck secures in place the stresses imparted to the steel beams.

17 Claims, 11 Drawing Sheets

U.S. PATENT DOCUMENTS

| | | | | | |
|---|---|---|---|---|---|
| 3,944,242 | A | | 3/1976 | Eubank | |
| 4,301,565 | A | * | 11/1981 | Weinbaum | 14/77.1 |
| 4,493,177 | A | * | 1/1985 | Grossman | 52/745.2 |
| 4,604,841 | A | * | 8/1986 | Barnoff et al. | 52/174 |
| 4,646,493 | A | | 3/1987 | Grossman | |
| 4,700,516 | A | * | 10/1987 | Grossman | 52/223.1 |
| 4,709,456 | A | * | 12/1987 | Iyer | 29/897.35 |
| 4,809,474 | A | * | 3/1989 | Ekberg, Jr. | 52/223.6 |
| 4,972,537 | A | * | 11/1990 | Slaw, Sr. | 14/77.1 |
| 5,144,710 | A | | 9/1992 | Grossman | |
| 5,305,575 | A | * | 4/1994 | Grossman | 52/745.2 |
| 5,311,629 | A | * | 5/1994 | Smith | 14/73.1 |
| 5,471,694 | A | * | 12/1995 | Meheen | 14/73 |
| 5,603,134 | A | * | 2/1997 | Whipkey et al. | 14/2.4 |
| 5,644,890 | A | * | 7/1997 | Koo | 52/742.14 |
| 5,950,390 | A | | 9/1999 | Jones | |
| 5,978,997 | A | * | 11/1999 | Grossman | 14/73 |
| 5,987,680 | A | * | 11/1999 | Sakaya | 14/73 |
| 6,065,257 | A | | 5/2000 | Nacey et al. | |
| 6,170,105 | B1 | * | 1/2001 | Doyle et al. | 14/73 |
| 6,381,793 | B2 | | 5/2002 | Doyle et al. | |
| 6,412,132 | B1 | * | 7/2002 | Majnaric et al. | 14/77.1 |
| 6,434,893 | B1 | | 8/2002 | Quenzi | |
| 6,467,223 | B1 | * | 10/2002 | Christley | 52/143 |
| 6,708,362 | B1 | * | 3/2004 | Allen | 14/73 |
| 6,915,615 | B2 | * | 7/2005 | Won | 52/720.1 |
| 2001/0039773 | A1 | * | 11/2001 | Bot | 52/259 |
| 2003/0182883 | A1 | * | 10/2003 | Won | 52/223.8 |
| 2004/0040233 | A1 | * | 3/2004 | Park | 52/223.8 |
| 2004/0118066 | A1 | * | 6/2004 | DeLoach, Sr. | 52/414 |
| 2004/0216249 | A1 | * | 11/2004 | El-Badry | 14/13 |
| 2005/0115195 | A1 | * | 6/2005 | Bettigole et al. | 52/782.1 |
| 2005/0283926 | A1 | * | 12/2005 | Pollard et al. | 14/77.1 |

OTHER PUBLICATIONS

Inverset Bridge System, J.W. Peters and Sons, Inc., Highway Products Div. (1998).

Inverset Bridge System, "Tappen Zee Bridge, Hudson River, New York" (Jul. 21, 1997).

Inverset Bridge System, "Design, Installation, Technical Manual," J.W. Peters and Sons, Inc.

Commonwealth of Pennsylvania, Dept. of Trans., "Research Project No. 92-056, 'Inverset' Bridge Deck Evaluation," Final Report (Jan. 1997), Brian St. John and Marcella Jo Lucas.

* cited by examiner

SECTION A-A

SECTION B-B

SECTION C-C

SECTION D-D

SECTION E-E

SECTION F-F

PREFABRICATED, PRESTRESSED BRIDGE SYSTEM AND METHOD OF MAKING SAME

CROSS-REFERENCE TO RELATED APPLICATIONS

The present application claims priority from U.S. Provisional Application No. 60/645,990 filed Jan. 21, 2005, entitled Prefabricated, Prestressed Bridge System and Method of Making Same.

BACKGROUND

This invention relates to a prefabricated, prestressed bridge system and a method for making same. Prefabricated, prestressed bridges are commonly known, however, the prefabricated, prestressed bridges currently available are cumbersome to manufacture and difficult to erect resulting in an expensive, labor-intensive final product. Prefabricated, prestressed bridges are used in a variety of civil engineering applications such as disclosed in U.S. Pat. No. 5,471,694 Prefabricated Bridge with Prestressed Elements ("Meheen patent"); U.S. Pat. No. 4,493,177 Composite, Pre-Stressed Structural Member and Method for Forming Same ("Grossman patent"); and U.S. Pat. No. 2,373,072 Rigid Frame Bridge and Method of Making the Same ("Wichert patent"). However, improvements are desired to provide a more easily manufacturable, more robust system with more integrated components which assist in providing the prestress to the bridge beams. Implementation of these improvements results in lower cost and increased speed of construction of a prefabricated, prestressed bridge system.

The Meheen patent discloses a prefabricated bridge beam with prestressed elements comprising a rectangular girder-box assembly which includes a bottom plate prestressed in compression and a pair of upstanding side members each having its upper portions prestressed in tension. A poured and cured bridge deck is supported by the said side members, the cured deck securing in place the said tension and compression stresses. However, the Meehan bridge beam utilizes a cantilevered load to deform the bridge beam. And, the Meehan beam lacks integrated structural members that provide constant, localized loads for prestressing.

The Grossman patent discloses a composite, prestressed structural member comprised of concrete and a lower metal support member, and a method for forming and prestressing the same. However, the Grossman structural member requires inversion to a concrete-uppermost position prior to use.

The Wichert patent relates to rigid frame bridges and the fabrication and construction thereof. The Wichert method for fabricating the rigid frame bridge discloses holding the metal span portion of the bridge against sagging upon application of the concrete or, alternatively, positively pressing upwardly the metal span portion prior to pouring the concrete. However, the Wichert rigid frame bridge does not utilize integrated structural members to achieve prestressing.

Accordingly, an apparatus, system, and method are desired for solving the aforementioned problems and providing the aforementioned advantages.

SUMMARY OF THE INVENTION

The present invention includes a novel prefabricated, prestressed bridge system and method for making same. The prefabricated, prestressed bridge system is a prefabricated, prestressed beam that can be used in a variety of construction applications including, but not limited to, bridge applications.

The prefabricated, prestressed bridge system includes one or more prefabricated, prestressed bridge modules.

A method for making the prefabricated, prestressed bridge module comprises providing and arranging one or more steel beams on three or more supporting formwork elements such that the first supporting formwork element is at a first outer end of the one or more steel beams, the second supporting formwork element is at the middle of the one or more steel beams, the third supporting formwork element is at a second outer end of the one or more steel beams, and the additional formwork elements are at one or more intermediary locations between the first outer end and the middle of the one or more steel beams and at one or more intermediary locations between the second outer end and the middle of the one or more steel beams. The method further comprises adding shear connectors to the one or more steel beams, positioning and extending rebar through the one or more steel beams in a direction perpendicular to the one or more steel beams and above at least two of the supporting formwork elements, pouring concrete to form concrete diaphragms on top of and around the rebar at locations above the supporting formwork elements, adjusting one or more of the supporting formwork elements to stress the one or more steel beams, and fabricating a concrete deck to form a surface atop the diaphragms and the one or more steel beams such that resulting compression stress of the concrete deck secures in place the stresses imparted to the one or more steel beams.

Each prefabricated, prestressed bridge module comprises one or more steel beams arranged on three or more supporting formwork elements such that the first supporting formwork element is at the first outer end of the one or more steel beams, the second supporting formwork element is at the middle of the one or more steel beams, the third supporting formwork element is at a second outer end of the one or more steel beams, and the additional supporting formwork elements are at one or more intermediary locations between the first outer end and the middle of the one or more steel beams and at one or more intermediary locations between the second outer end and the middle of the one or more steel beams. The prefabricated, prestressed bridge module further comprises shear connectors on the one or more steel beams, rebar that runs through the one or more steel beams in a direction perpendicular to the one or more steel beams and above at least two of the supporting formwork elements, concrete material poured to form concrete diaphragms on top of and around the rebar at locations above the supporting formwork elements, one or more supporting formwork elements that are adjusted to stress the one or more steel beams, and a concrete deck fabricated over the surface atop the diaphragms and the one or more steel beams such that resulting compression stress of the concrete deck secures in place the stresses imparted to the one or more steel beams. A prefabricated, prestressed bridge system comprising two or more prefabricated, prestressed bridge modules secured together is also a subject of the present invention.

Accordingly, an object of the present invention is to provide a prefabricated, prestressed bridge module in which camber is produced by selectively lowering supporting formwork elements under the bridge module components while the prefabricated, prestressed bridge module is being made. Alternatively, camber may be achieved by selectively raising one or more supporting formwork elements under the bridge module components while the prefabricated, prestressed bridge module is being made.

It is an additional object of this invention to provide a prefabricated, prestressed bridge module which utilizes the weight of diaphragms in combination with the adjustment of supporting formwork elements to produce camber.

It is an additional object of this invention to provide a prefabricated, prestressed bridge module which uses the weight of diaphragms, the adjustment of supporting formwork elements, and an externally applied load to produce camber.

It is an additional object of the invention to provide a prefabricated, prestressed bridge module which utilizes steel beams that are trapezoidal-shaped, I-beam-shaped, or shaped like other steel beams commonly used in the civil engineering industry.

It is an additional object of the invention to provide a prefabricated, prestressed bridge system that is faster to make, more efficient, and more affordable than other prefabricated, prestressed bridges.

It is an additional object of the invention to provide a prefabricated, prestressed bridge system that consists of one or more prefabricated, prestressed bridge modules that can be joined with one another to make prefabricated, prestressed bridge systems of various sizes.

It is an additional object of the invention to provide a method of making a prefabricated, prestressed bridge system that can be made in a first location and delivered to a second location for installation and use.

It is an additional object of the invention to provide a prefabricated, prestressed bridge module where the diaphragms and the concrete deck of the prefabricated, prestressed bridge module can be poured monolithically and the height levels of each of the three or more supporting formwork elements adjusted into predetermined cambered positions during the pour.

An additional object of the invention is to provide a prefabricated, prestressed bridge system that can serve as a prefabricated, prestressed beam that can be used in a variety of construction applications, including but not limited to bridge applications.

Other and still further objects, features, and advantages of the invention will become apparent from a reading of the following detailed description of the invention taken in connection with the accompanying drawings.

DETAILED DESCRIPTION OF PREFERRED EMBODIMENTS

Figure 1:
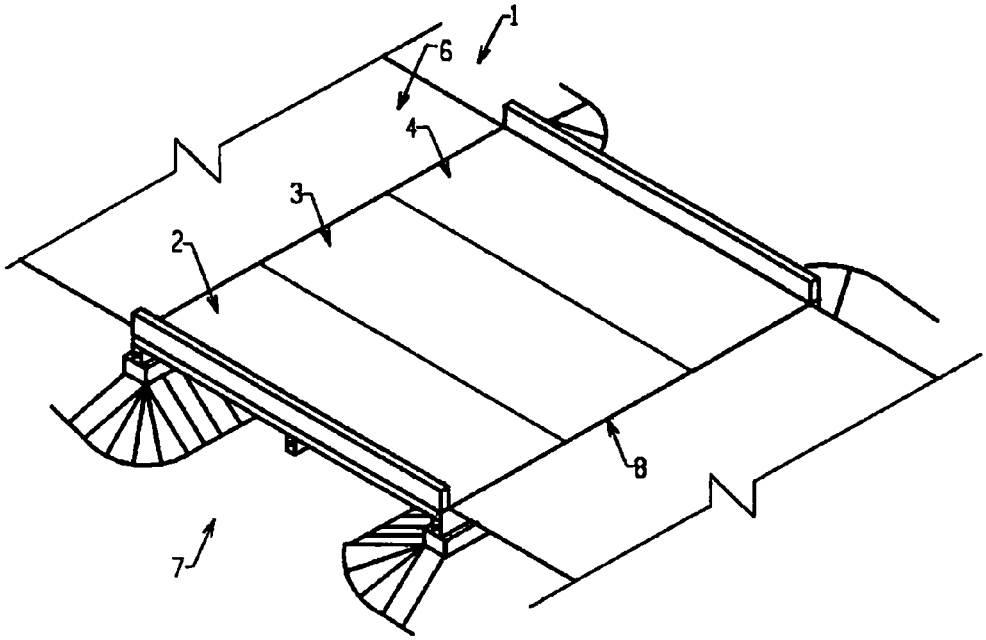
FIG. 1 is a perspective view of a bridge embodying an embodiment of the prefabricated, prestressed bridge system of the present invention.

FIG. 1 is an overview of a bridge 1 constructed from the side by side combination of three prefabricated, prestressed modules 2, 3, and 4. The three prefabricated, prestressed modules 2, 3 and 4 comprise the prefabricated, prestressed bridge system 8. The bridge system 8 is a continuation of roadway 6, spanning a depression area shown generally at 7.

Figure 2:
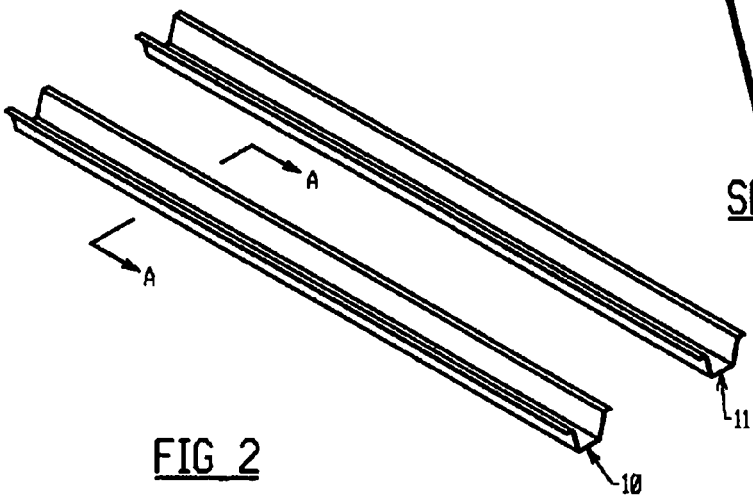
FIG. 2 is a perspective view of the steel beams used in FIG. 1.
Figure 2A:
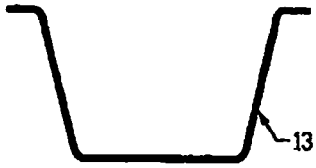
FIG. 2*a* is a cross-sectional view taken through one of the steel beams in FIG. 2.

FIGS. 2-7 show the steps for constructing one of the prefabricated, prestressed modules 2, 3, or 4 shown in FIG. 1. FIG. 2 shows steel beams 10 and 11 which form the support for a prefabricated, prestressed module. Steel beams 10 and 11 are formed of steel plate bent into a trapezoidal "U" shape. FIG. 2*a* shows a cross-sectional view 13 of the steel beams 10 and 11.

Figure 3A:
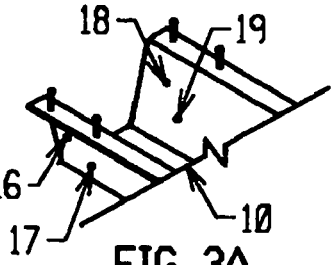
FIG. 3*a* is a first exploded view of a steel beam with holes and shear connectors of FIG. 3.
Figure 3B:
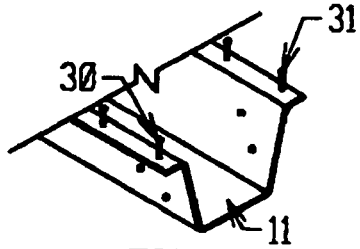
FIG. 3*b* is a second exploded view of a steel beam with holes and shear connectors of FIG. 3.
Figure 3:
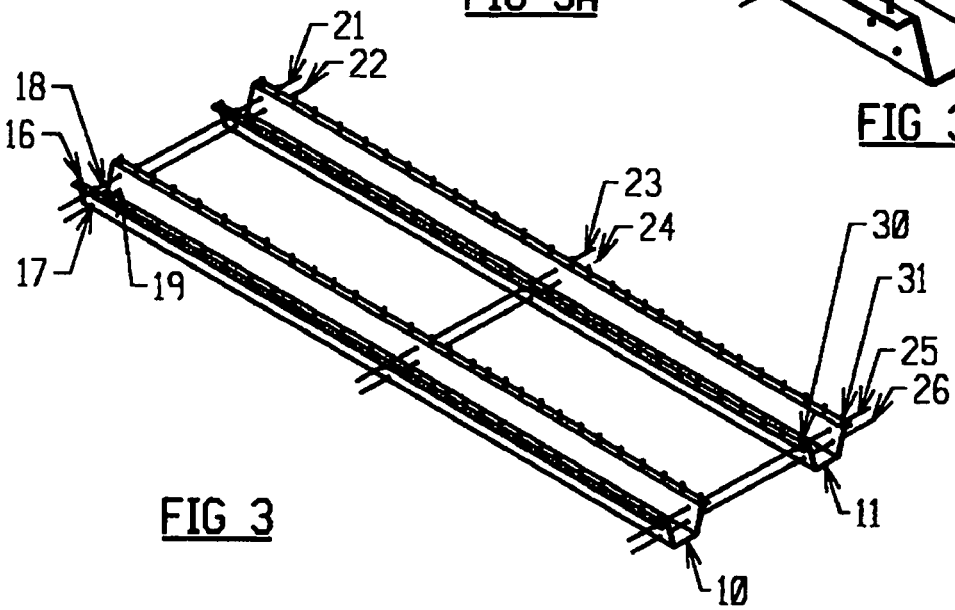
FIG. 3 is a perspective view of the steel beams with rebar and shear connectors used in FIG. 1.

FIG. 3 shows the steel beams 10 and 11 with steel reinforcement bars 21, 22, 23, 24, 25, and 26 running between steel beams 10 and 11. The steel reinforcement bars 21, 22, 23, 24, 25, and 26 are known in the bridge construction industry as "rebar." Each steel reinforcement bar 21, 22, 23, 24, 25, and 26 connects steel beams 10 and 11. Steel beams 10 and 11 have holes in them through which the steel reinforcement bars 21, 22, 23, 24, 25, and 26 are run. Examples of the holes are shown at 16, 17, 18, and 19. FIG. 3*a* is an exploded view of the section of steel beam 10 with holes 16, 17, 18, and 19. FIG. 3 also shows the shear connectors located on steel beams 10 and 11. Examples of the shear connectors are shown at 30 and 31. FIG. 3*b* is an exploded view of the section of steel beam 11 with shear connectors 30 and 31.

Figure 4:
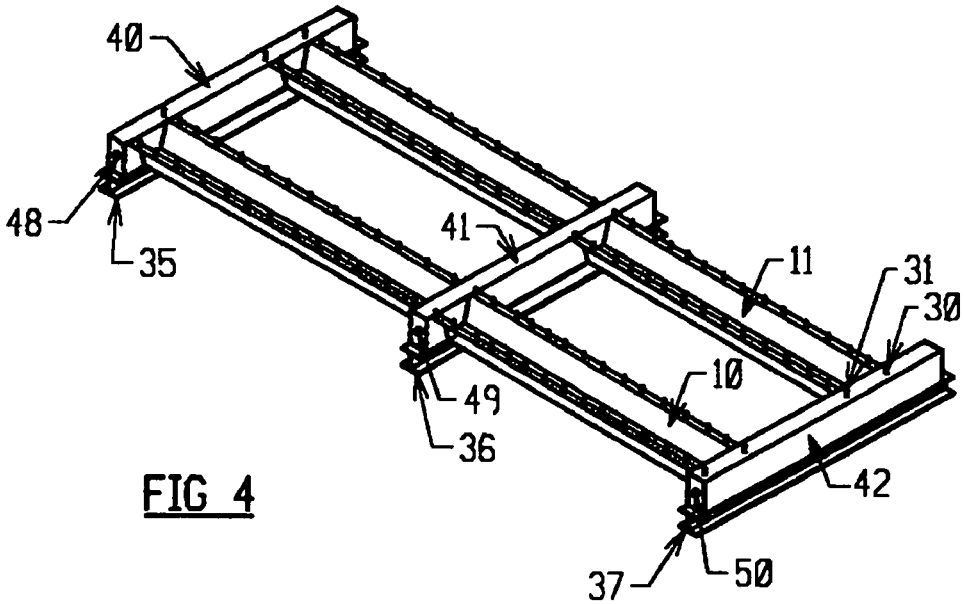
FIG. 4 is a perspective view of the steel beams, shear connectors, supporting formwork elements, and diaphragms used in FIG. 1.

FIG. 4 shows the steel beams 10 and 11 placed atop supporting formwork elements 35, 36, and 37. Supporting formwork element 35 is the first supporting formwork element and it is at the first outer end of the steel beams 10 and 11. Supporting formwork element 36 is the second supporting formwork element and it is at the middle of the steel beams 10 and 11. Supporting formwork element 37 is the third supporting formwork element and it is at the second outer end of the steel beams 10 and 11. Though the supporting formwork elements 35, 36, and 37 are depicted in what is known as the "I Beam" shape in FIG. 4, supporting formwork of another shape known in the construction industry may be used. In the ideal case, each supporting formwork element 35, 36, and 37 sits on a flat surface that is level with the surface of the other two formwork elements. Referring to FIG. 3 and FIG. 4, the steel beams 10 and 11 are placed atop supporting formwork elements 35, 36, and 37 so that the steel reinforcement bars 21, 22, 23, 24, 25, and 26 are placed above the supporting formwork elements 35, 36, and 37 and run along the supporting formwork elements 35, 36, and 37. FIG. 4 shows diaphragms 40, 41, and 42 formed by pouring concrete in an area above the supporting formwork elements 35, 36, and 37 and around the steel reinforcement bars 21, 22, 23, 24, 25, and 26 until the concrete reaches at least the level of the top surface of the steel beams 10 and 11. Wood forms that are of common use in the bridge construction industry are used to form the shape of the diaphragms 40, 41, and 42 before the concrete is poured to make the diaphragms. The concrete is poured into the wood forms and the top level of concrete that reaches at least the level of the top surface of the steel beams 10 and 11 is leveled by manual labor. After the concrete dries and becomes solid, the wood forms are removed. The diaphragms may be poured in such a manner that holes 48, 49, and 50 are formed in each diaphragm 40, 41, and 42, respectively, and run through each diaphragm 40, 41, and 42 and the steel beams 10 and 11.

Figure 5:
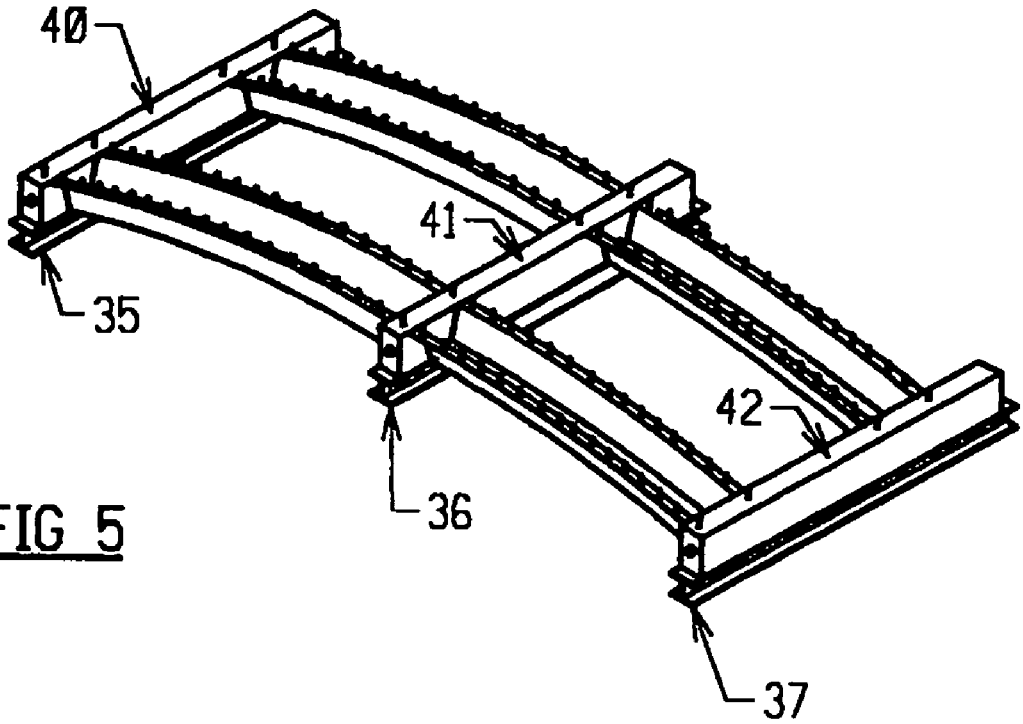
FIG. 5 is a perspective view of the steel beams, shear connectors, supporting formwork elements, and diaphragms used in FIG. 1 in a camber-producing arrangement.

FIG. 5 shows the novel method of prestressing the prefabricated, prestressed bridge module by producing camber in the steel beams 10 and 11 by lowering the supporting formwork elements 35 and 37 to allow the steel beams 10 and 11 to bend under the weight of diaphragms 40 and 42. Camber is defined as providing curvature in a beam opposite in direction to that corresponding to deflections of the beam under load. Alternatively, camber can be produced in the steel beams 10 and 11 of the prefabricated, prestressed bridge module by raising the supporting formwork element 36 to allow the steel beams 10 and 11 to bend under the weight of diaphragms 40 and 42.

Figure 5A:
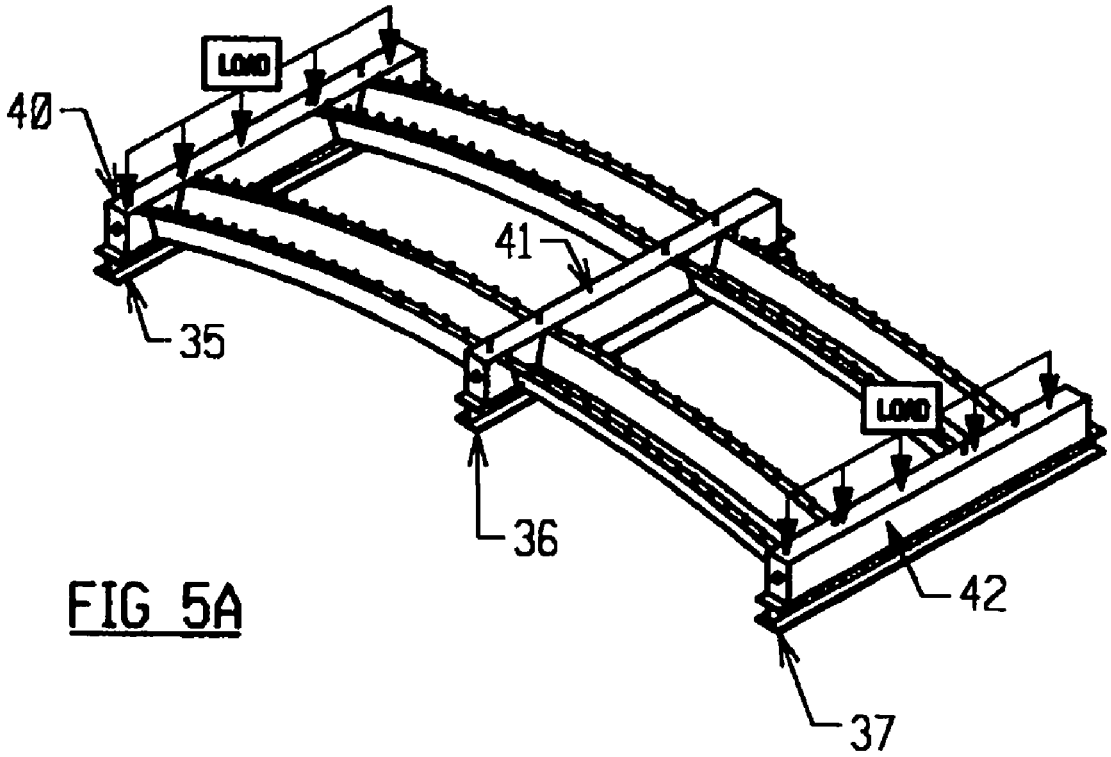
FIG. 5*a* is a perspective view of the steel beams, shear connectors, supporting formwork elements, and diaphragms with external loads in a camber-producing arrangement used in FIG. 5.

FIG. 5*a* shows external loads for creating camber applied to the prefabricated, prestressed bridge module of FIG. 5. Prestressing of the prefabricated, prestressed bridge module to produce camber in the steel beams 10, 11 may be achieved without the use of external loads. However, external loads may be utilized to aid in the production of camber.

The diaphragms provide a unique, efficient, cost-effective means to pre-camber the steel beams. When the prefabricated, prestressed bridge module is used alone or in combination with one or more prefabricated, prestressed bridge modules, the concrete diaphragms that are not at the ends of the steel beams distribute live loads that the prefabricated, prestressed bridge module bears over the one or more steel beams. When the prefabricated, prestressed bridge module is used alone or in combination with one or more prefabricated, prestressed bridge modules, the concrete diaphragms that are at the ends of the steel beams retain the earth at the bridge and roadway interface. The concrete diaphragms that are not at the middle of the one or more steel beams provide the weight required to pre-camber the steel beams.

The weights of the concrete diaphragms that are not at the middle of the one or more steel beams can be varied to produce specific amounts of camber in the one or more steel beams when one or more of the supporting formwork elements are adjusted to create camber in the one or more steel beams. The concrete diaphragms are an integral part of the prefabricated, prestressed bridge module's structure that serve the additional function of producing camber in the one or more steel beams when one or more of the supporting formwork elements are adjusted.

Figure 6:
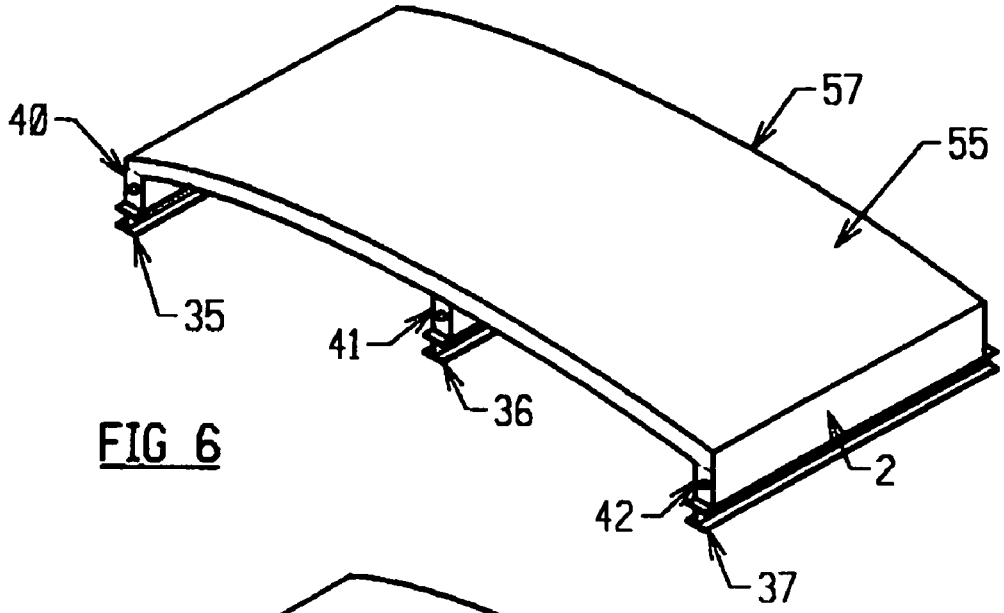
FIG. 6 is a perspective view of the steel beams, supporting formwork elements, and diaphragms used in FIG. 1 in a camber-producing arrangement with a concrete deck.

FIG. 6 shows a concrete deck 55 formed atop the diaphragms 40, 41, and 42 and atop the steel beams 10 and 11. The concrete deck 55 is poured after the supporting formwork elements 35, 36, and 37 are set at a level so that supporting formwork elements 35 and 37 are at the same level with one another and so that supporting formwork elements 35 and 37 are lower than the level of supporting formwork element 36. Steel forms that are of common use in the bridge construction industry are used form the shape of the concrete deck 55 before the concrete is poured to make the concrete deck. The concrete deck is poured over steel reinforcements placed in the space the concrete deck will occupy after it is poured. The steel reinforcements are part of the concrete deck, and they are of common use in the bridge construction industry. The concrete is poured into the steel forms and the top surface of the concrete deck 57 is leveled by manual labor. Alternatively, wood forms may be used in place of steel forms to make the shape of the concrete deck 55 before the concrete is poured to make the concrete deck. Depending on the length of the steel beams, intermediary supports, in addition to the supporting formwork elements below the diaphragms and in addition to the second supporting formwork element if the second supporting formwork element does not have a diaphragm above it, may be needed to support the stressed steel beams. After the concrete deck 55 of the prefabricated, prestressed bridge module 2 has dried, the prefabricated, prestressed bridge module 2 can be removed from the three supporting formwork elements 35, 36, and 37 and is ready for use as a bridge by itself or as part of a prefabricated, prestressed bridge system 8.

Figure 6A:
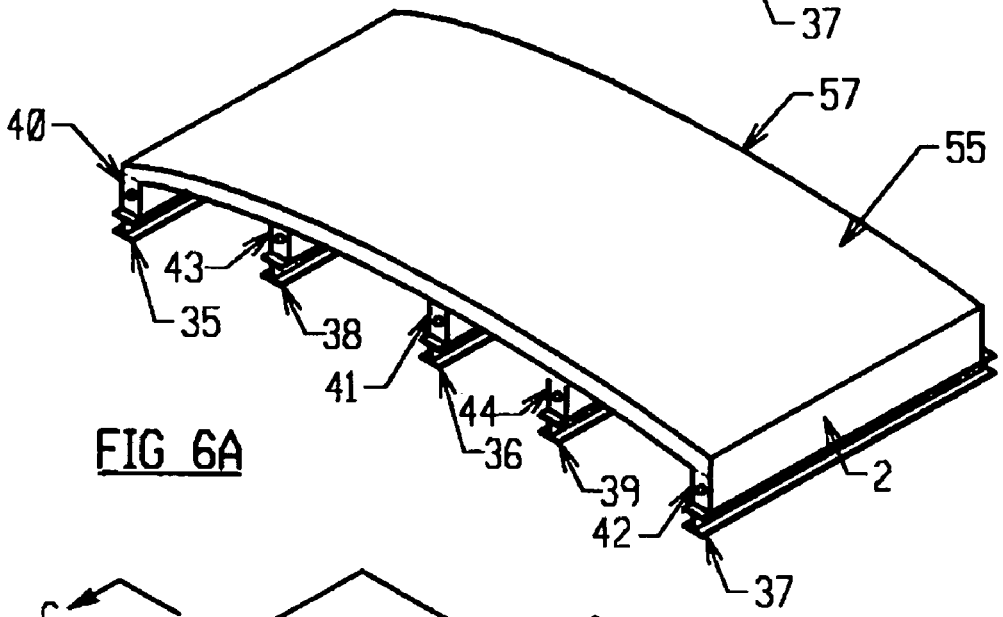
FIG. 6*a* is a perspective view of the steel beams, supporting formwork elements, and diaphragms in a camber-producing arrangement with a concrete deck of an alternate embodiment.

FIG. 6*a* shows an alternate embodiment with five diaphragms 40, 43, 41, 44, 42 atop five supporting formwork elements 35, 38, 36, 39, 37.

Figure 7:
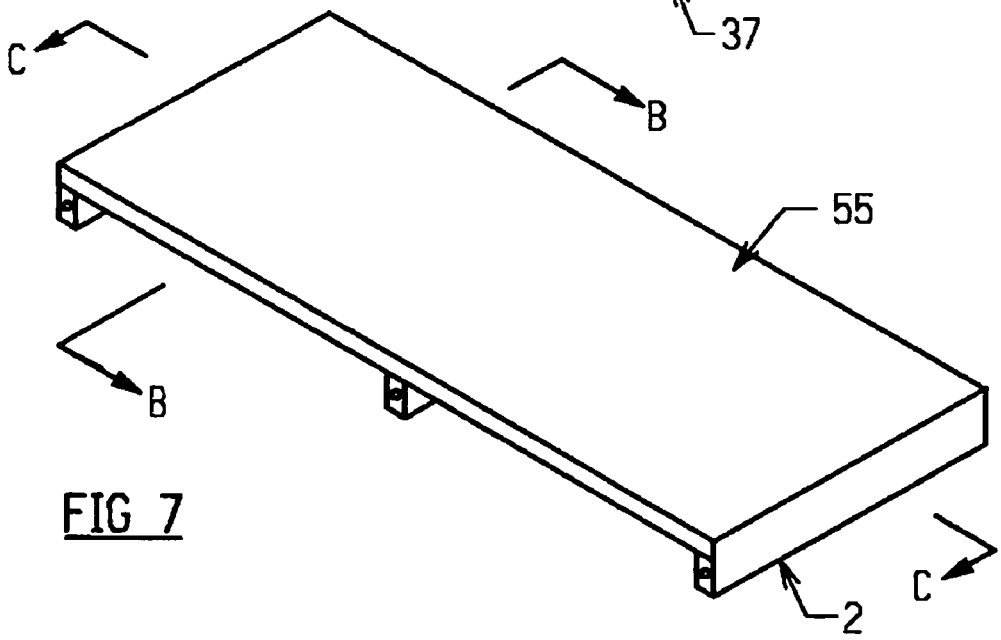
FIG. 7 is a perspective view of a completed prefabricated, prestressed bridge module used in FIG. 1.

FIG. 7 shows the prefabricated, prestressed bridge module 2 after the concrete deck 55 has dried and after the prefabricated, prestressed bridge module 2 has been removed from the supports 35, 36, and 37 shown in FIG. 6. The prefabricated, prestressed bridge module 2 is prestressed because the supporting formwork elements beneath the diaphragms are adjusted to stress the one or more steel beams and the concrete deck is fabricated to form a surface atop the diaphragms and the one or more steel beams such that resulting compression stress of the concrete deck secures in place the stresses imparted to the one or more steel beams. The prefabricated, prestressed bridge module 2, show in FIG. 7, can now be used in a prefabricated, prestressed bridge system as a single module, or in conjunction with one or more modules, as shown in FIG. 1.

Figure 7A:
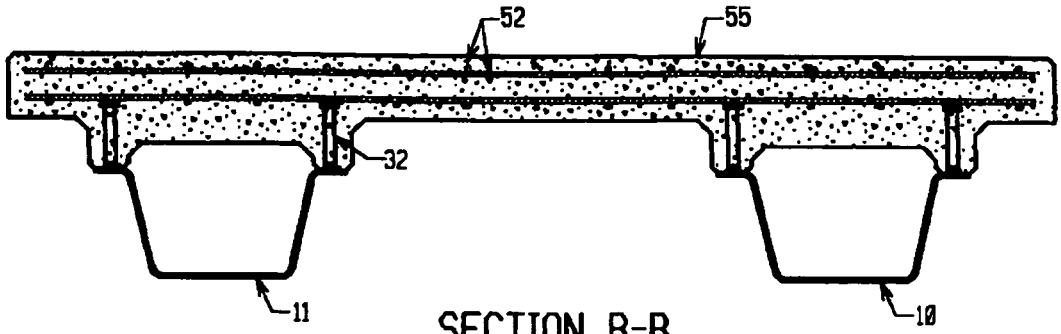
FIG. 7*a* is a first cross-sectional view taken through the completed prefabricated, prestressed bridge module of FIG. 7.

FIG. 7*a* shows a first cross-sectional view of the prefabricated, prestressed bridge module of FIG. 7. Shear connectors 32 are located on steel beams 10 and 11. Steel reinforcements 52 are within the concrete deck 55.

Figure 7B:
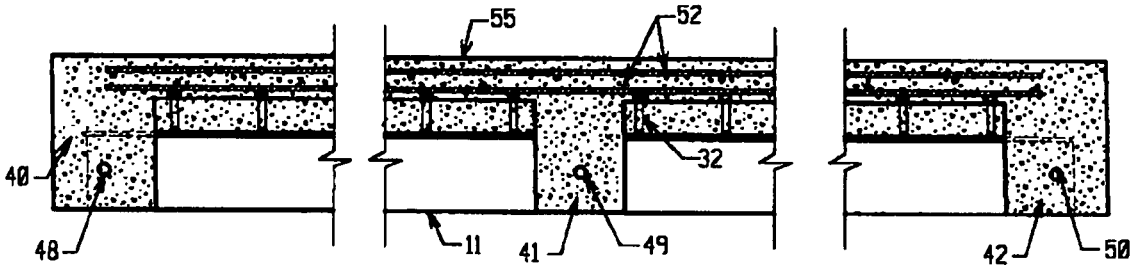
FIG. 7*b* is a second cross-sectional view taken through the completed prefabricated, prestressed bridge module of FIG. 7.

FIG. 7*b* shows a second cross-sectional view of the prefabricated, prestressed bridge module of FIG. 7. Shear connectors 32 are located on the steel beams 10 and 11. Steel reinforcements 52 are within the concrete deck 55. Holes 48, 49, 50 run through diaphragms 40, 41, and 42 and steel beams 10 and 11.

In combination with adjustment of one or more of the supporting formwork elements, the weight of the diaphragms stresses the one or more steel beams before the concrete deck is fabricated atop the one or more steel beams and diaphragms. The concrete deck forms a surface atop the diaphragms and the one or more steel beams such that resulting compression stress of the concrete deck secures in place the stresses imparted to the one or more steel beams.

Figure 8:
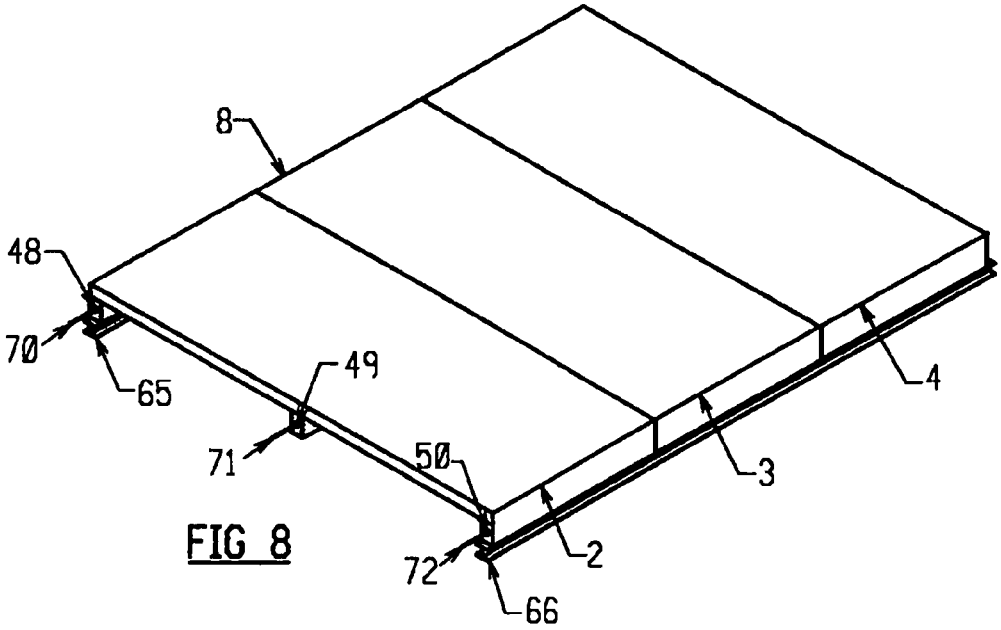
FIG. 8 is a perspective view of a prefabricated, prestressed bridge system consisting of three prefabricated, prestressed bridge modules secured with tensioning rods used in FIG. 1.

FIG. 8 shows the prefabricated, prestressed bridge module 2 and the tensioning manner of joining it with prefabricated, prestressed bridge modules 3 and 4 to form a prefabricated, prestressed bridge system 8. Each prefabricated, prestressed, bridge module 2, 3, and 4 is placed atop support beams 65 and 66. Tensioning rods 70, 71, and 72 are threaded through holes 48, 49, and 50 in each prefabricated, prestressed bridge module 2, 3, and 4. The tensioning rods 70, 71, and 72 are tightened to pull prefabricated, prestressed bridge modules 2, 3, and 4 together to form the prefabricated, prestressed bridge system 8 of bridge 1 in FIG. 1. The tensioning rods 70, 71, and 72 are commonly used in the bridge construction industry. The method of tightening the tensioning rods 70, 71, and 72 is also commonly known in the bridge construction industry. Epoxy resin, which is commonly known in the bridge construction industry, may be used between module 2 and module 3 and between module 3 and module 4.

Figure 9:
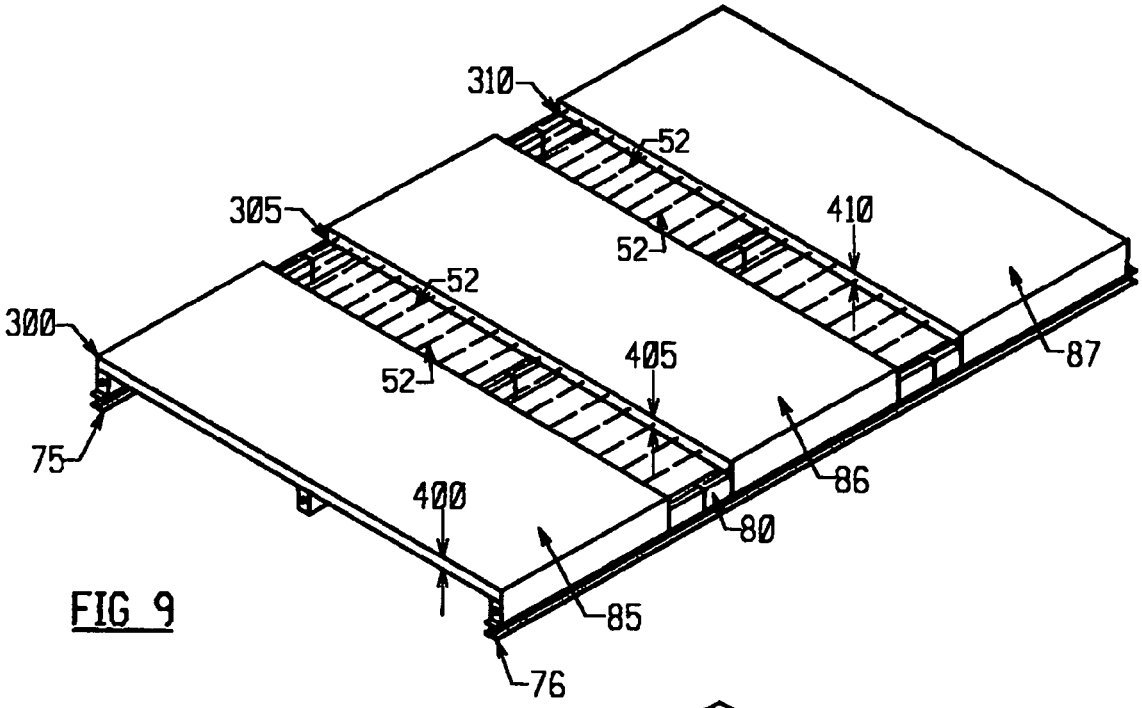
FIG. 9 is a perspective view of a prefabricated, prestressed bridge system consisting of three prefabricated, prestressed bridge modules arranged for joining with cast in place concrete.
Figure 10:
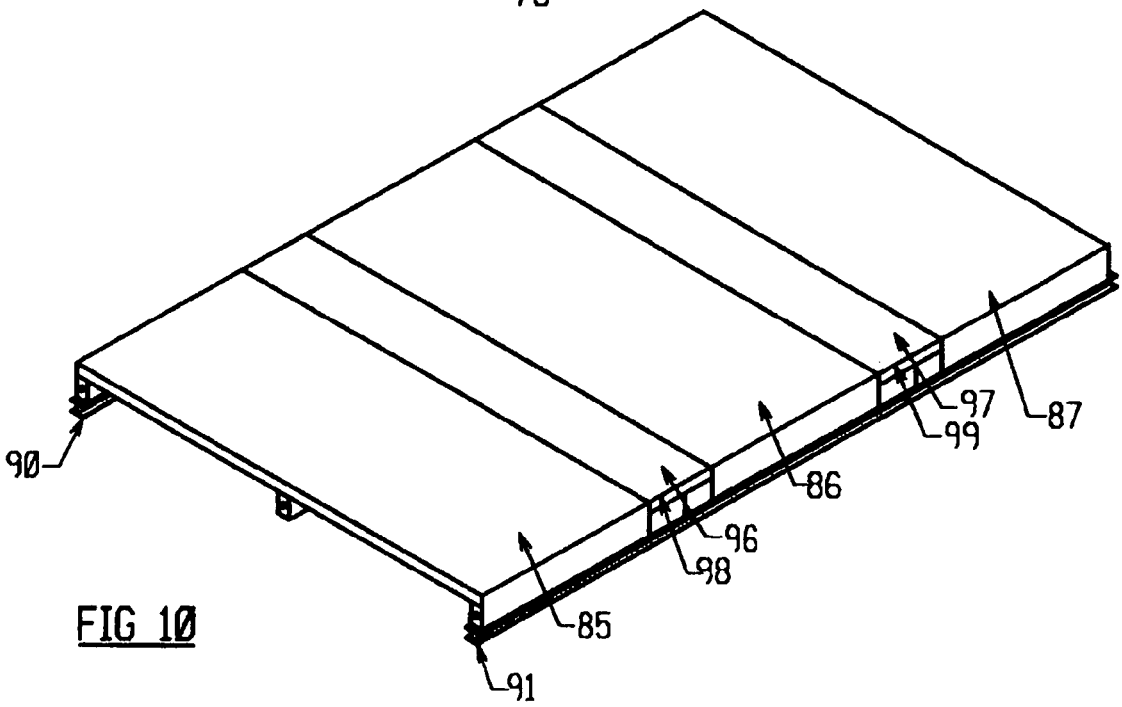
FIG. 10 is a perspective view of a prefabricated, prestressed bridge system consisting of three prefabricated, prestressed bridge modules joined with cast in place concrete used in FIG. 9.

FIG. 9 and FIG. 10 show a cast in place method of connecting three prefabricated, prestressed bridge modules 85, 86, and 87 to create a prefabricated, prestressed bridge system. FIG. 9 shows the prefabricated, prestressed bridge modules 85, 86, and 87 placed on support beams 75 and 76. FIG. 9 also shows a plurality of steel reinforcements 52. FIG. 10 shows cast in place connection 96 poured between module 85 and module 86 and cast in place connection 97 poured between module 86 and module 87. The cast in place connections 96 and 97 are concrete. With reference to FIG. 9 and FIG. 10, the cast in place connections 96 and 97 are poured so that they are approximately the same concrete depth 400, 405 and 410 as the concrete decks 300, 305, and 310 of modules 85, 86, and 87, respectively. With reference to FIG. 9 and FIG. 10, the cast in place connections 96 and 97 are poured over and around the steel reinforcements 52. The steel reinforcements 52 are of common use in the bridge construction industry. Steel forms that are of common use in the construction industry are used form the shape of the cast in place connections 96 and 97 before the concrete is poured to make the cast in place connections 96 and 97. The concrete is poured into the steel forms and the top surfaces 98 and 99 of cast in place connections 96 and 97, respectively, are leveled by manual labor. The top surfaces 98 and 99 of the cast in place connections 96 and 97, respectively, are level with the top surfaces of the prefabricated, prestressed bridge modules 85, 86, and 87. Alternatively, wood forms may be used instead of steel forms.

Figure 11:
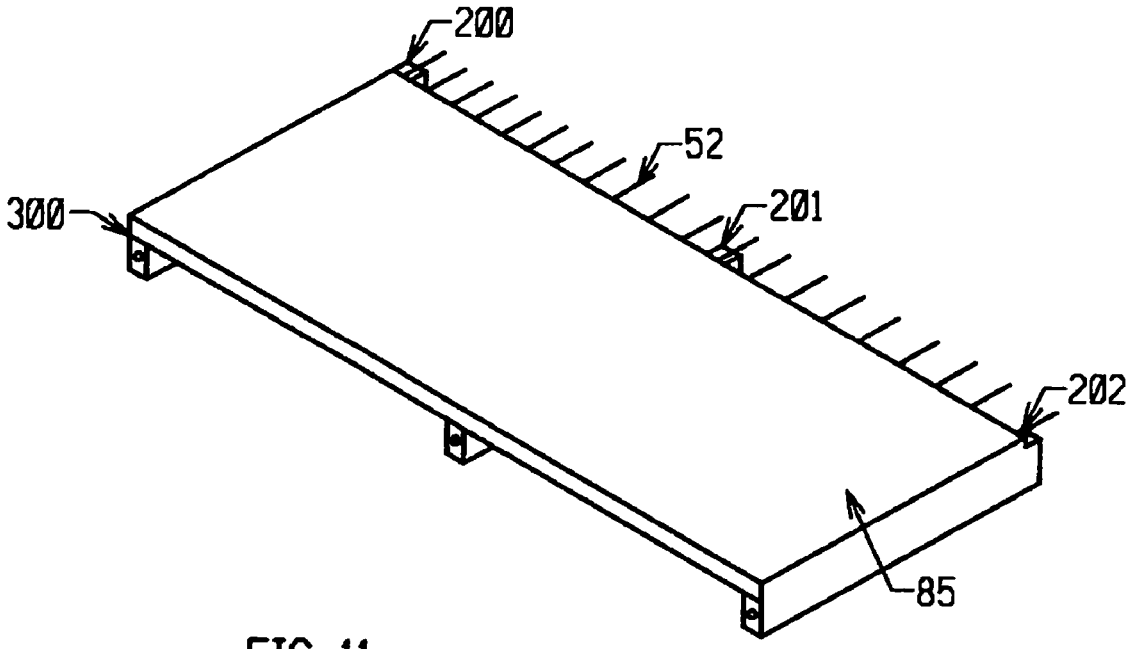
FIG. 11 is a perspective view of a first prefabricated, prestressed bridge module for use in a prefabricated, prestressed bridge system joined with cast in place concrete used in FIG. 9.

FIG. 11 shows a prefabricated, prestressed bridge module 85 fabricated for use in a cast in place prefabricated, prestressed bridge module. The prefabricated, prestressed bridge module 85 has elongated diaphragms 200, 201, and 202. A plurality of continuous steel reinforcements 52 are within module 85 and protrude from module 85.

Figure 12:
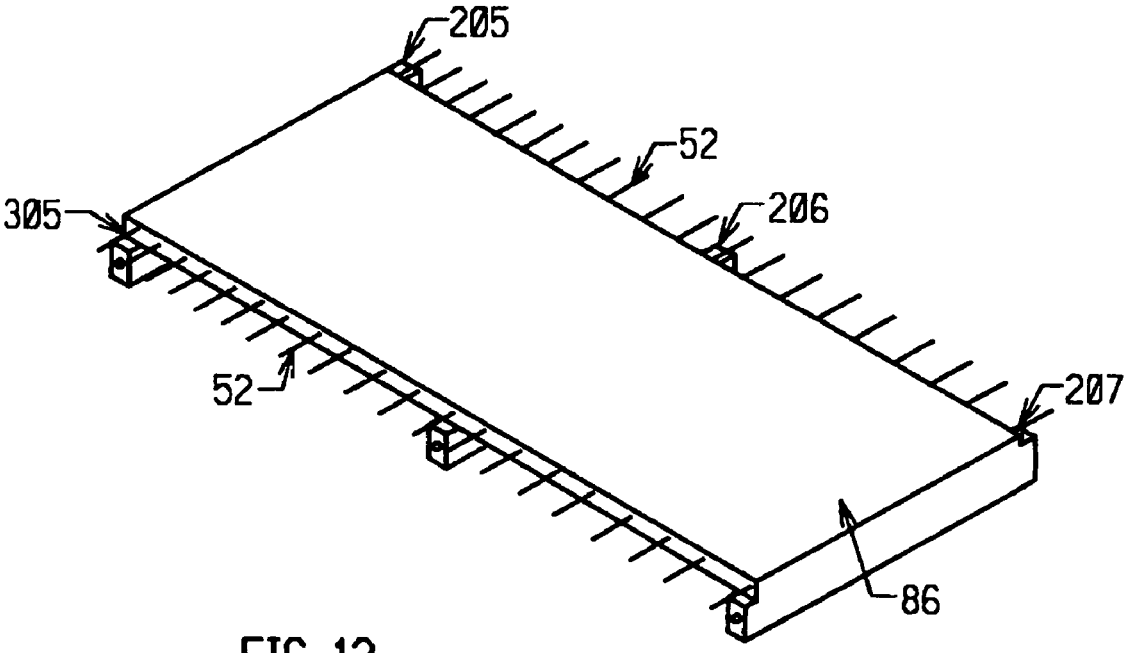
FIG. 12 is a perspective view of a second prefabricated, prestressed bridge module for use in a prefabricated, prestressed bridge system joined with cast in place concrete used in FIG. 9.

FIG. 12 shows a prefabricated, prestressed bridge module 86 fabricated for use in a cast in place prefabricated, prestressed bridge module. The prefabricated, prestressed bridge module 86 has elongated diaphragms 205, 206, and 207. A plurality of continuous steel reinforcements 52 run through module 86 and protrude from module 86.

Figure 13:
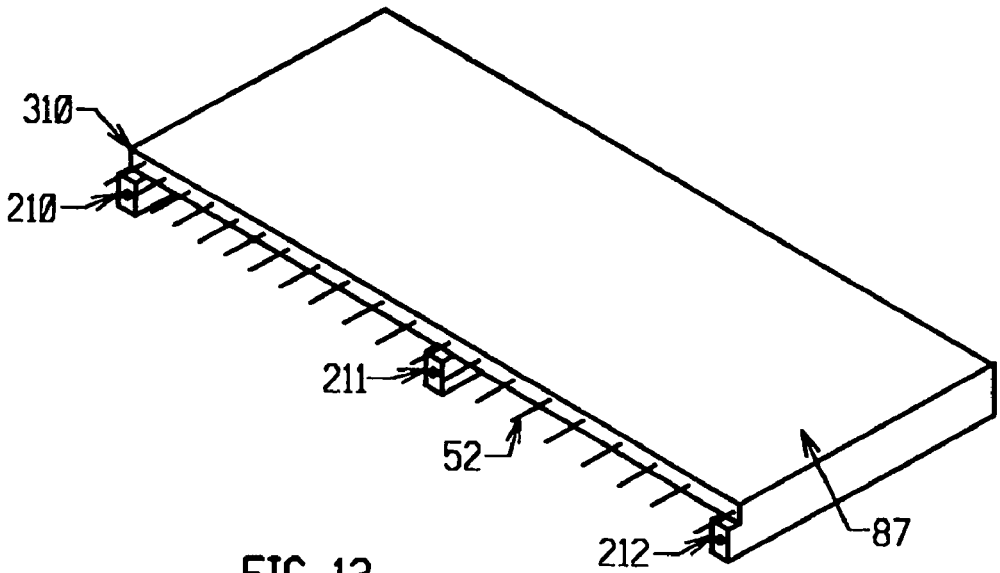
FIG. 13 is a perspective view of a third prefabricated, prestressed bridge module for use in a prefabricated, prestressed bridge system joined with cast in place concrete used in FIG. 9.
Figure 14:
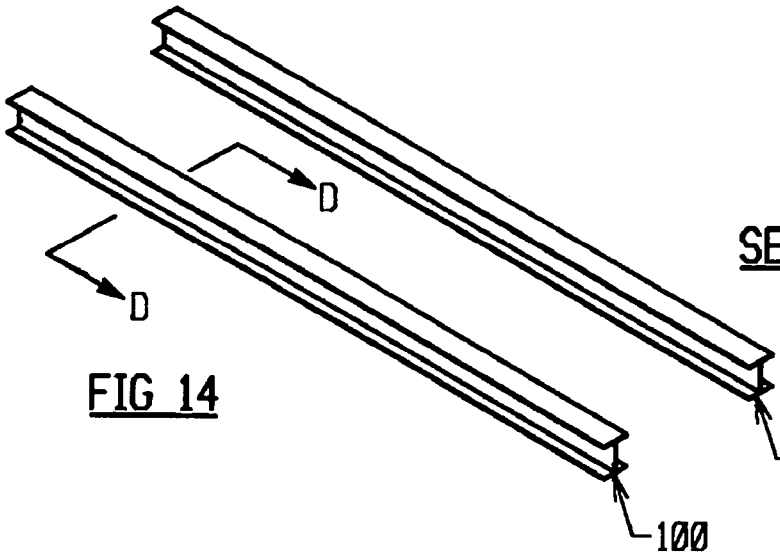
FIG. 14 is a perspective view of the steel beams used in an alternate embodiment.
Figure 14A:
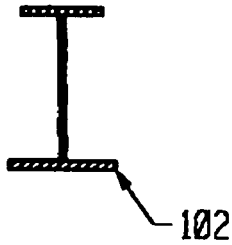
FIG. 14*a* is a cross-sectional view taken through one of the steel beams in FIG. 14 used in an alternate embodiment.
Figure 15:
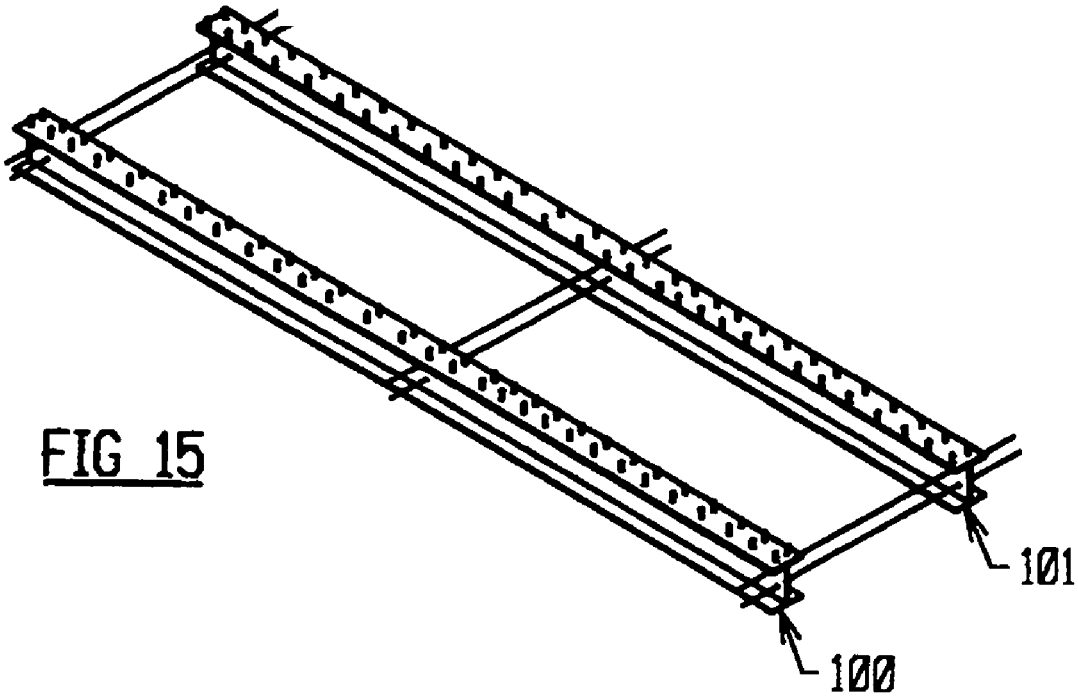
FIG. 15 is a perspective view of the steel beams with shear connectors and rebar of an alternate embodiment.
Figure 16:
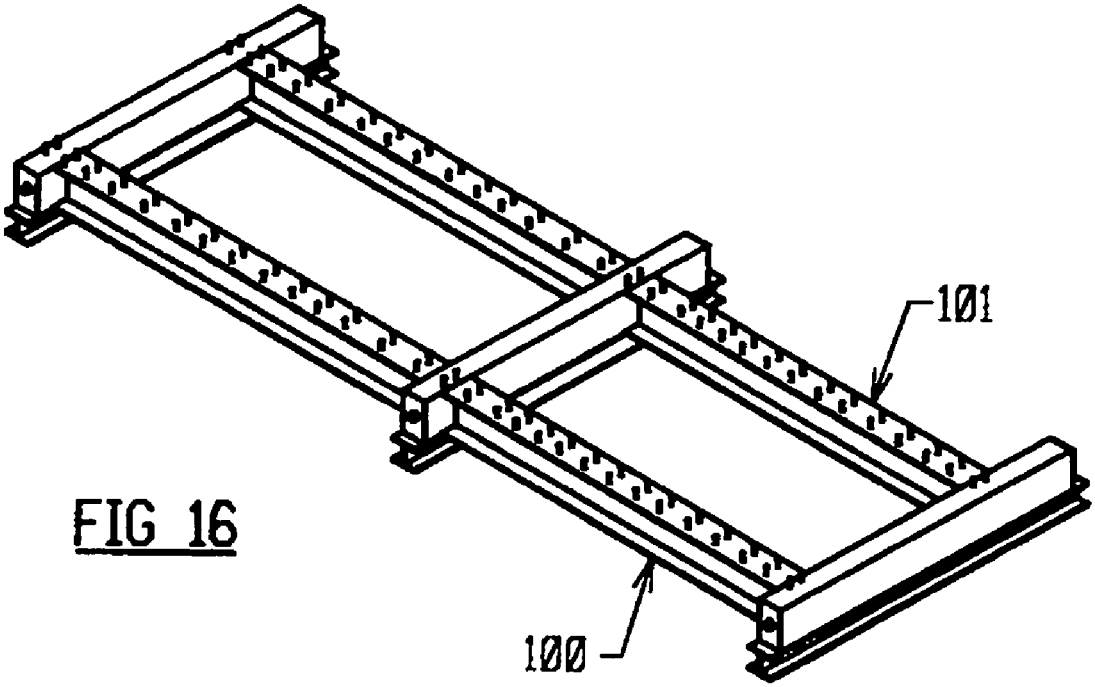
FIG. 16 is a perspective view of the steel beams, shear connectors, supporting formwork elements, and diaphragms of an alternate embodiment.

FIG. 13 shows a prefabricated, prestressed bridge module 87 fabricated for use in a cast in place prefabricated, prestressed bridge module. The prefabricated, prestressed bridge module 87 has elongated diaphragms 210, 211, and 212. A plurality of continuous steel reinforcements 52 are within module 87 and protrude from module 87.

An alternate embodiment may be made by utilizing steel beams that have a different shape than steel beams 10 and 11. The alternate embodiment utilizes steel beams 100 and 101 that are an in an "I beam" shape that is commonly used in the construction industry. FIGS. 14, 14*a*, 15, 16, 17, 17*a*, 18, 18*a*, and 18*b* show the alternate embodiment that utilizes "I beam" shaped beams 100 and 101. When "I beam" shaped beams 100 and 101 are used, the final appearance of the alternate embodiment will still look like that of FIGS. 1, 6, 7, 8, 9, 10, 11, 12, and 13. In addition to trapezoidal-shaped steel beams 10, 11 and I-beam shaped steel beams 100, 101, other steel beam shapes commonly used in the construction industry may be used.

Figure 17:
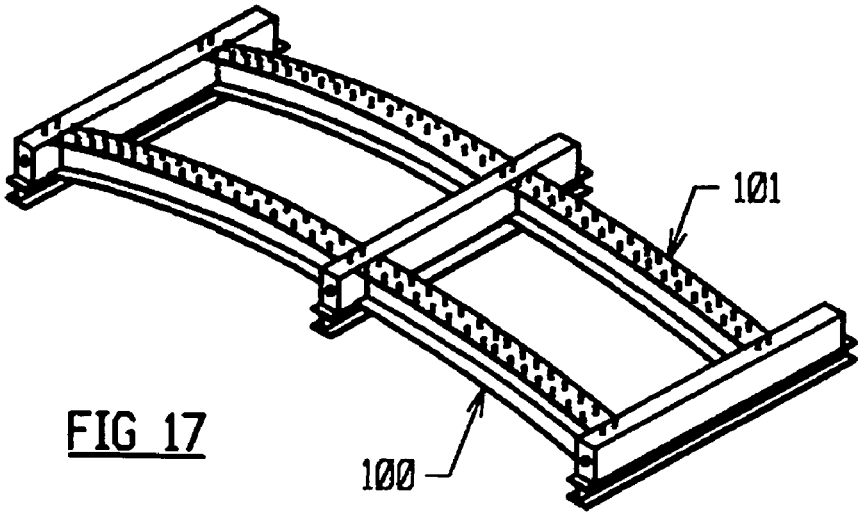
FIG. 17 is a perspective view of the steel beams, shear connectors, supporting formwork elements, and diaphragms in a camber-producing arrangement of an alternate embodiment.
Figure 17A:
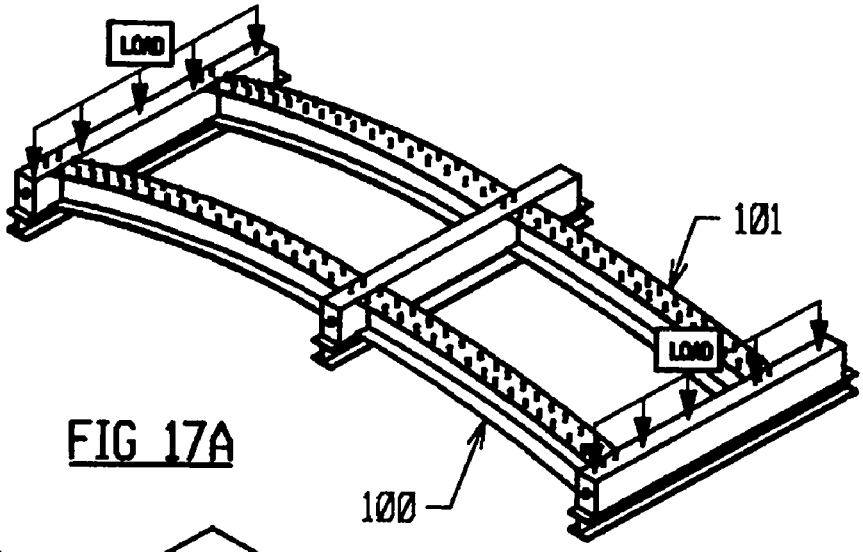
FIG. 17*a* is a perspective view of the steel beams, shear connectors, supporting formwork elements, and diaphragms with external loads in a camber-producing arrangement of an alternate embodiment.

FIG. 17*a* shows external loads for creating camber applied to the prefabricated, prestressed bridge module of FIG. 17. Prestressing of the prefabricated, prestressed bridge module to produce camber in the steel beams 100, 101 may be achieved without the use of external loads. However, external loads may be utilized to aid in the production of camber.

Figure 18:
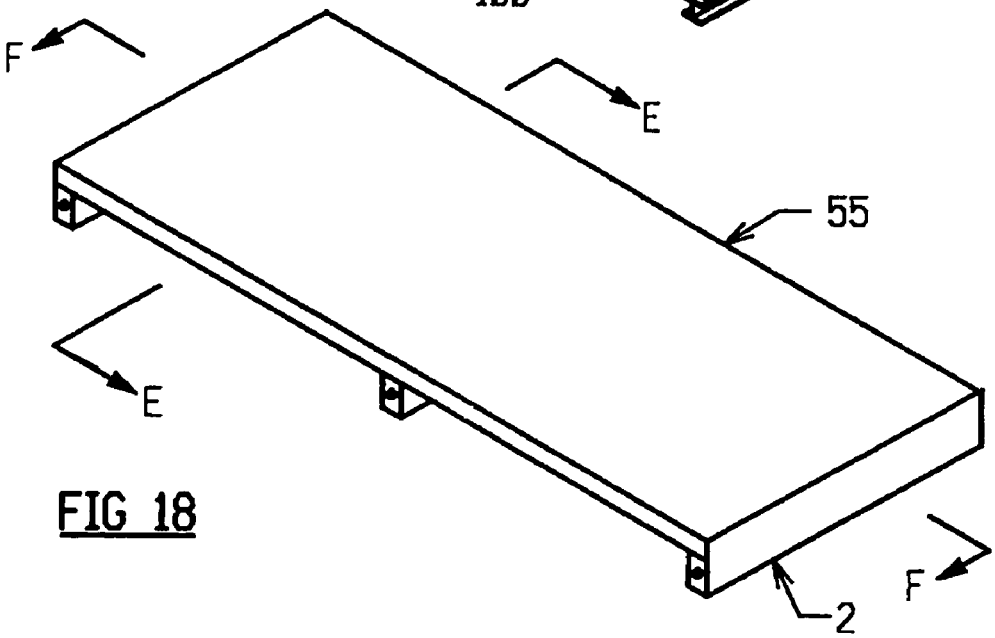
FIG. 18 is a perspective view a completed prefabricated, prestressed bridge module of an alternate embodiment.

FIG. 18 shows a perspective view a completed prefabricated, prestressed bridge module of an alternate embodiment.

Figure 18A:
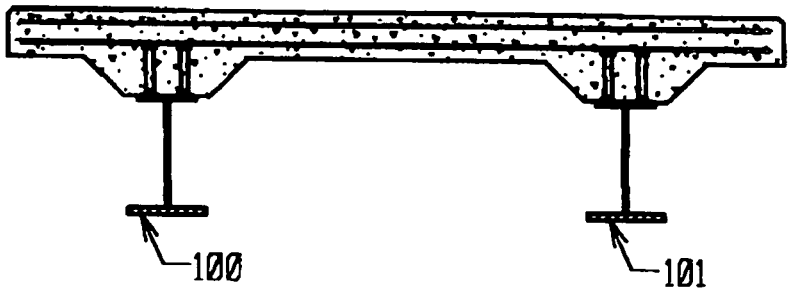
FIG. 18*a* is a first cross-sectional view taken through the completed prefabricated, prestressed bridge module of an alternate embodiment in FIG. 18.

FIG. 18*a* shows a first cross-sectional view taken through the completed prefabricated, prestressed bridge module of the alternate embodiment of FIG. 18.

Figure 18B:
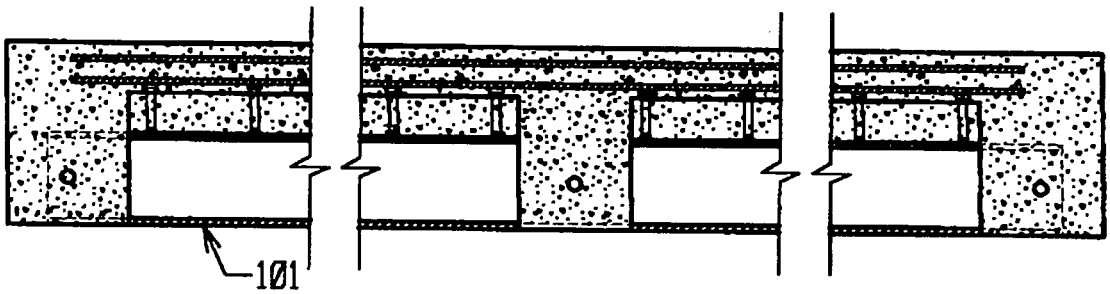
FIG. 18*b* is a second cross-sectional view taken through the completed prefabricated, prestressed bridge module of an alternate embodiment in FIG. 18.

FIG. 18*b* shows a second cross-sectional view taken through the completed prefabricated, prestressed bridge module of the alternate embodiment of FIG. 18.

The invention of the present prefabricated, prestressed bridge system may be made with one, two, or three prefabricated, prestressed modules. Also, it is contemplated that a scope of the present invention includes the fact that the prefabricated, prestressed bridge system may utilize more than three prefabricated, prestressed modules.

Similarly, the present prefabricated, prestressed bridge system may comprise one or more prefabricated, prestressed modules that use one or more steel beams in each prefabricated, prestressed module. The invention of the present prefabricated, prestressed bridge system may also utilize two or more diaphragms and more than three supporting formwork elements in each prefabricated, prestressed module to achieve the necessary camber.

The present prefabricated, prestressed bridge system utilizes the weight of the diaphragms and, if necessary, an externally applied load to produce camber.

The diaphragms and the concrete deck of the present prefabricated, prestressed bridge system may be poured monolithically and the height levels of one or more of the three or more supporting formwork elements adjusted into predetermined cambered positions during the pour.

Accordingly the present invention provides a prefabricated, prestressed bridge system in which camber is produced by selectively lowering or raising one or more supporting formwork elements while the prefabricated, prestressed bridge system is being made.

In the foregoing description, it will be readily appreciated by those skilled in the art that modifications may be made to the invention without departing form the concepts disclosed herein. Such modifications are to be considered as included in the following claims, unless these claims by their language expressly state otherwise.

The invention claimed is:

1. A method for making a prefabricated, prestressed bridge module comprising:

providing and arranging one or more steel beams having U-shaped cross sections and supported on three or more supporting formwork elements such that the first supporting formwork element is at a first outer end of the one or more steel beams, the second supporting formwork element is at a middle of the one or more steel beams, the third supporting formwork element is at a second outer end of the one or more steel beams;

adding shear connectors to the one or more steel beams;

positioning and extending rebar through the one or more steel beams in a direction perpendicular to the one or more steel beams and above at least two of the supporting formwork elements;

pouring concrete to form concrete diaphragms on top of and around the rebar at locations above the supporting formwork elements, the diaphragms each extending into cavities defined by the U-shaped steel beams and extending between the U-shaped steel beams;

adjusting one or more of the supporting formwork elements to stress the one or more steel beams; and fabricating a concrete deck to form a surface atop the diaphragms and the one or more steel beams such that resulting compression stress of the concrete deck secures in place the stresses imparted to the one or more steel beams, the deck resting on a top of the U-shaped steel beams and diaphragms and not extending below the top of the steel beams.

2. The method of claim 1, wherein said providing and arranging step comprises providing and arranging only the first supporting formwork element, the second supporting formwork element, and the third supporting formwork element.

3. The method of claim 2, wherein said adjusting step comprises lowering the first and third supporting formwork elements.

4. The method of claim 2, wherein said adjusting step comprises raising the second supporting formwork element.

5. The method of claim 3, wherein said adjusting step further comprises applying external loads to the concrete diaphragms atop the first and third supporting formwork elements.

6. The method of claim 4, wherein said adjusting step further comprises applying external loads to the concrete diaphragms atop the first and third supporting formwork elements.

7. The method of claim 1, wherein said adjusting step comprises applying external loads to all of the concrete diaphragms that are not on top of the second supporting formwork element.

8. A prefabricated, prestressed bridge module comprising:

one or more steel beams having a U-shaped cross section and arranged on three or more supporting formwork elements such that the first supporting formwork element is at a first outer end of the one or more steel beams, the second supporting formwork element is at a middle of the one or more steel beams, the third supporting formwork element is at a second outer end of the one or more steel beams;

shear connectors on the one or more steel beams;

rebar that runs through the one or more steel beams in a direction perpendicular to the one or more steel beams and above at least two of the supporting formwork elements;

concrete material poured to form concrete diaphragms on top of and around the rebar at locations above the supporting formwork elements;

the supporting formwork elements being adjusted to stress the one or more steel beams; and a concrete deck fabricated atop the diaphragms and the one or more steel beams such that resulting compression stress of the concrete deck secures in place the stresses imparted to the one or more steel beams.

9. The prefabricated, prestressed bridge module of claim 8, wherein said three or more supporting formwork elements consist of the first supporting formwork element, the second supporting formwork element, and the third supporting formwork element.

10. The prefabricated, prestressed bridge module of claim 9, wherein the first and third supporting formwork elements are lowered to stress the one or more steel beams.

11. The prefabricated, prestressed bridge module of claim 9, wherein the second formwork element is raised to stress the one or more steel beams.

12. The prefabricated, prestressed bridge module of claim 10, wherein an external load is applied to the concrete diaphragms atop the first and third supporting formwork elements.

13. The prefabricated, prestressed bridge module of claim 11, wherein an external load is applied to the concrete diaphragms atop the first and third supporting formwork elements.

14. The prefabricated, prestressed bridge module of claim 8, wherein external loads are applied to all of the concrete diaphragms that are not on top of the second supporting formwork element.

15. A prefabricated, prestressed bridge system comprising:

two or more of the prefabricated, prestressed bridge modules as defined in claim 8 secured together.

16. The prefabricated, prestressed bridge system of claim 15, wherein two or more prefabricated, prestressed bridge modules are secured together with tensioning rods such that said tensioning rods are threaded through holes in each of said prefabricated, prestressed bridge modules and tightened.

17. The prefabricated, prestressed bridge system of claim 15, wherein each of said two or more prefabricated, prestressed bridge modules have elongated concrete diaphragms;

said prefabricated, prestressed bridge modules are secured together with one or more cast in place connections poured between the concrete decks of the prefabricated, prestressed bridge modules and above the elongated diaphragms of the prefabricated, prestressed bridge modules.

* * * * *